US011008083B2

(12) United States Patent
Mizutani

(10) Patent No.: US 11,008,083 B2
(45) Date of Patent: May 18, 2021

(54) STEERING ASSIST UNIT AND BOAT MANEUVERING SYSTEM

(71) Applicant: YAMAHA HATSUDOKI KABUSHIKI KAISHA, Iwata (JP)

(72) Inventor: Makoto Mizutani, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 16/735,747

(22) Filed: Jan. 7, 2020

(65) Prior Publication Data

US 2020/0290713 A1 Sep. 17, 2020

(30) Foreign Application Priority Data

Mar. 15, 2019 (JP) ..... JP2019-048500

(51) Int. Cl.
*B63H 20/12* (2006.01)
*B63H 25/42* (2006.01)

(52) U.S. Cl.
CPC ..... *B63H 20/12* (2013.01); *B63H 25/42* (2013.01); *B63H 2025/425* (2013.01)

(58) Field of Classification Search
CPC ..... B63H 20/00; B63H 20/12; B63H 25/00; B63H 25/42
USPC ..... 114/144 R, 150; 440/61 R, 61 S
See application file for complete search history.

(56) References Cited

U.S. PATENT DOCUMENTS

| | | | | |
|---|---|---|---|---|
| 6,715,438 | B1 | 4/2004 | Hundertmark | |
| 7,104,857 | B1 * | 9/2006 | Swan | B63H 25/12 440/61 S |
| 7,325,507 | B1 * | 2/2008 | Hundertmark | B63H 20/12 114/150 |
| 7,681,513 | B1 | 3/2010 | Hundertmark | |
| 2004/0069198 | A1 | 4/2004 | Hundertmark | |

FOREIGN PATENT DOCUMENTS

EP 3 156 320 A1 4/2017

OTHER PUBLICATIONS

Official Communication issued in corresponding European Patent Application No. 20162976.3, dated Sep. 15, 2020.

* cited by examiner

*Primary Examiner* — Lars A Olson
(74) *Attorney, Agent, or Firm* — Keating and Bennett, LLP

(57) ABSTRACT

A steering assist unit for a tiller handle of an outboard motor includes a housing, a pump, and a hydraulic actuator. The housing is connected to the tiller handle. The pump is housed in the housing. The hydraulic actuator is driven by hydraulic fluid from the pump. The hydraulic actuator applies an assist steering force to the outboard motor.

16 Claims, 9 Drawing Sheets

STEERING ASSIST UNIT AND BOAT MANEUVERING SYSTEM

CROSS REFERENCE TO RELATED APPLICATIONS

This application claims the benefit of priority to Japanese Patent Application No. 2019-048500 filed on Mar. 15, 2019. The entire contents of this application are hereby incorporated herein by reference.

BACKGROUND OF THE INVENTION

1. Field of the Invention

The present disclosure relates to a steering assist unit and a boat maneuvering system.

2. Description of the Related Art

Some conventional boat maneuvering systems include a tiller handle and an actuator. For example, the boat maneuvering system disclosed in U.S. Pat. No. 6,715,438 includes an outboard motor, a tiller handle, a hydraulic cylinder, and a hydraulic pump. The tiller handle is connected to the outboard motor so that the outboard motor can be manually steered. The hydraulic cylinder is driven by hydraulic fluid from the hydraulic pump. The hydraulic cylinder is connected to the outboard motor so that the assist steering force acts on the outboard motor. The hydraulic pump is connected to the hydraulic cylinder by a hydraulic hose. The hydraulic pump is disposed in the boat.

In the conventional boat maneuvering system, a space for arranging the hydraulic pump in the boat is required. Therefore, the space in the boat is reduced.

SUMMARY OF THE INVENTION

Preferred embodiments of the present invention prevent a space in a boat from being reduced while providing an assist steering force when operating a tiller handle.

A first preferred embodiment according to the present disclosure provides a steering assist unit connected to a tiller handle of an outboard motor. The steering assist unit includes a housing, a pump, and a hydraulic actuator. The housing is connected to the tiller handle. The pump is located in the housing. The hydraulic actuator is driven by hydraulic fluid from the pump. The hydraulic actuator applies an assist steering force to the outboard motor.

A second preferred embodiment according to the present disclosure provides a boat maneuvering system. The boat maneuvering system includes an outboard motor, a tiller handle, and a steering assist unit. The tiller handle is connected to the outboard motor. The steering assist unit is connected to the tiller handle. The steering assist unit includes a housing, a pump, and a hydraulic actuator. The housing is connected to the tiller handle. The pump is located in the housing. The hydraulic actuator is driven by hydraulic fluid from the pump. The hydraulic actuator applies an assist steering force to the outboard motor.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
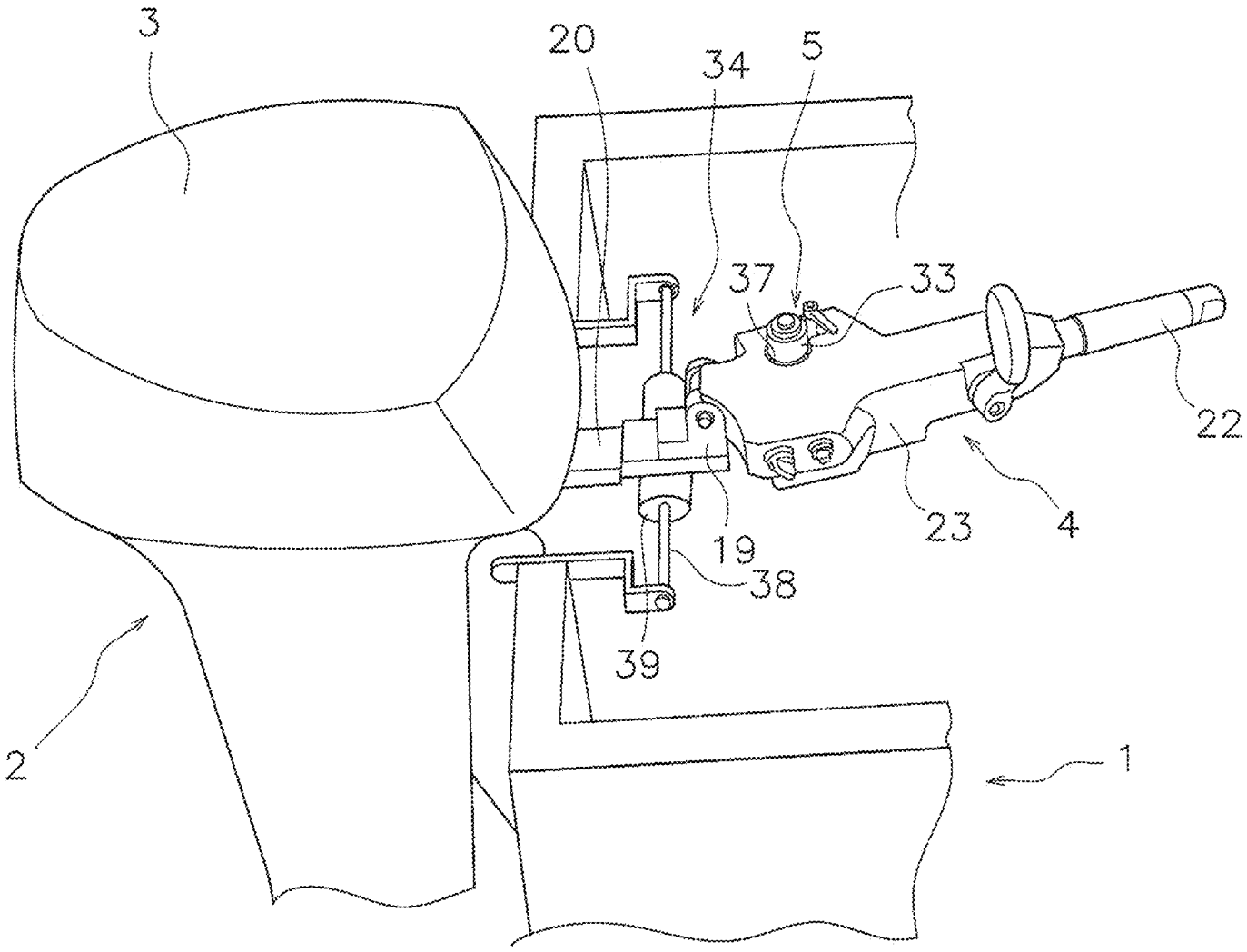
FIG. 1 is a schematic diagram showing a portion of a boat including a boat maneuvering system according to a preferred embodiment of the present invention.

Hereinafter, preferred embodiments will be described with reference to the drawings. FIG. 1 is a diagram illustrating a portion of a boat 1 on which a boat maneuvering system 2 is mounted. As illustrated in FIG. 1, the boat maneuvering system 2 includes an outboard motor 3, a tiller handle 4, and a steering assist unit 5. The outboard motor 3 is attached to the stern of the boat 1. The outboard motor 3 generates a propulsive force to propel the boat 1.

Figure 2:
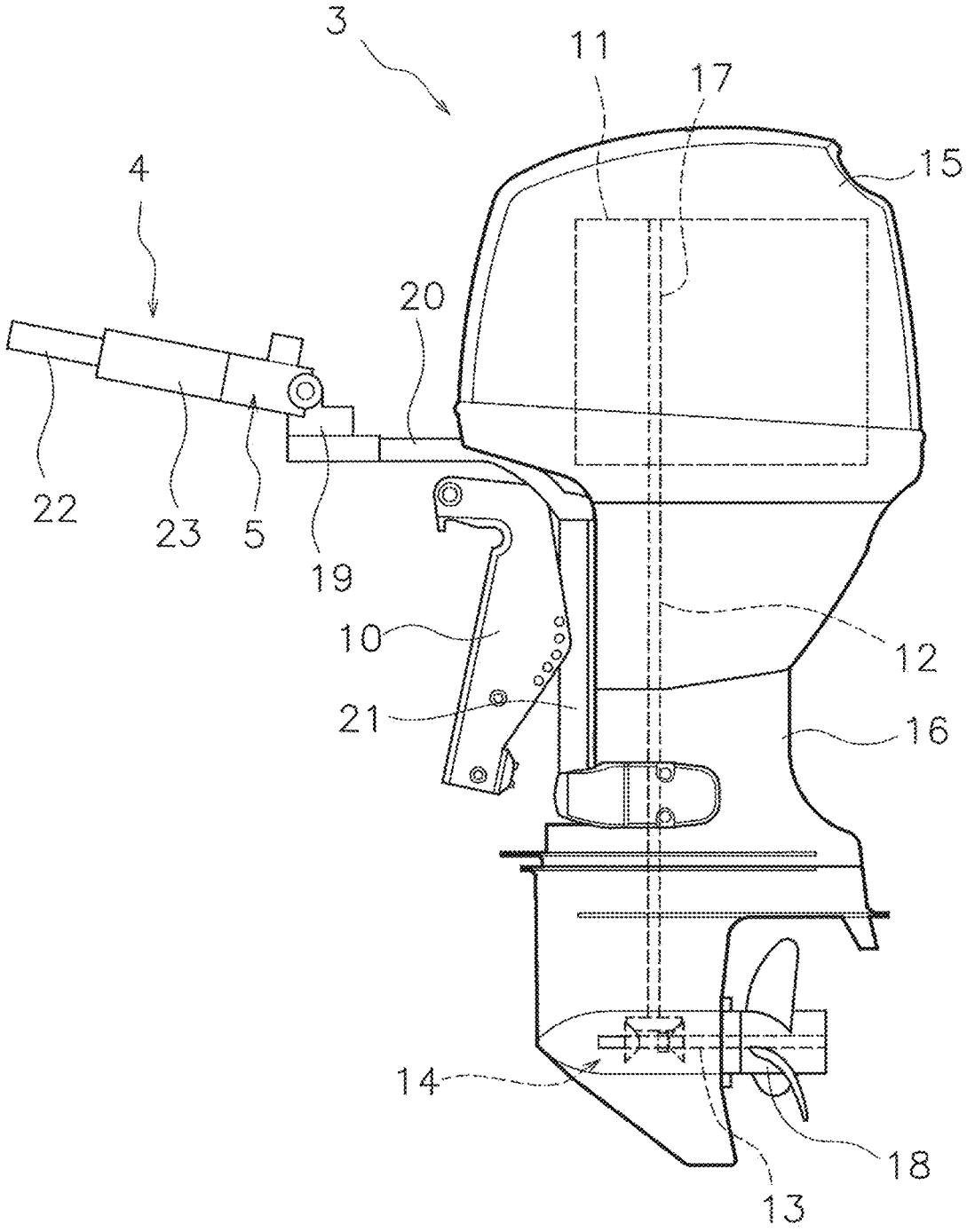
FIG. 2 is a side view of the boat maneuvering system.

FIG. 2 is a side view of the boat maneuvering system 2. As illustrated in FIG. 2, the outboard motor 3 includes an engine 11, a drive shaft 12, a propeller shaft 13, a shift mechanism 14, an engine cover 15, and a housing 16. The engine 11 generates a propulsive force to propel the boat 1. The engine 11 is disposed in the engine cover 15. The engine 11 includes a crankshaft 17. The crankshaft 17 extends in a vertical direction of the outboard motor 3. The drive shaft 12 is connected to the crankshaft 17. The drive shaft 12 extends in the vertical direction.

The propeller shaft 13 extends in a front-rear direction of the outboard motor 1. The propeller shaft 13 is connected to the drive shaft 12 by the shift mechanism 14. A propeller 18 is connected to the propeller shaft 13. The housing 16 is disposed below the engine cover 15. The drive shaft 12, the propeller shaft 13, and the shift mechanism 14 are disposed in the housing 16. The shift mechanism 14 switches a rotational direction of the power transmitted from the drive shaft 12 to the propeller shaft 13 between a forward direction and a reverse direction. The shift mechanism 14 includes a plurality of gears and a clutch that changes the meshing of the gears.

The outboard motor 3 includes a bracket 10 and a steering arm 20. The outboard motor 3 is attached to the boat 1 by the bracket 10. The bracket 10 includes a steering shaft 21. The outboard motor 3 is steered left and right around the steering shaft 21. The steering arm 20 extends forward from the outboard motor 3.

The tiller handle 4 is connected to the steering arm 20. A boat operator is able to manually steer the outboard motor 3 with the tiller handle 4. The steering assist unit 5 is connected to the tiller handle 4. The steering assist unit 5 applies an assist steering force to the outboard motor 3 during manual steering by a boat operator.

Figure 3:
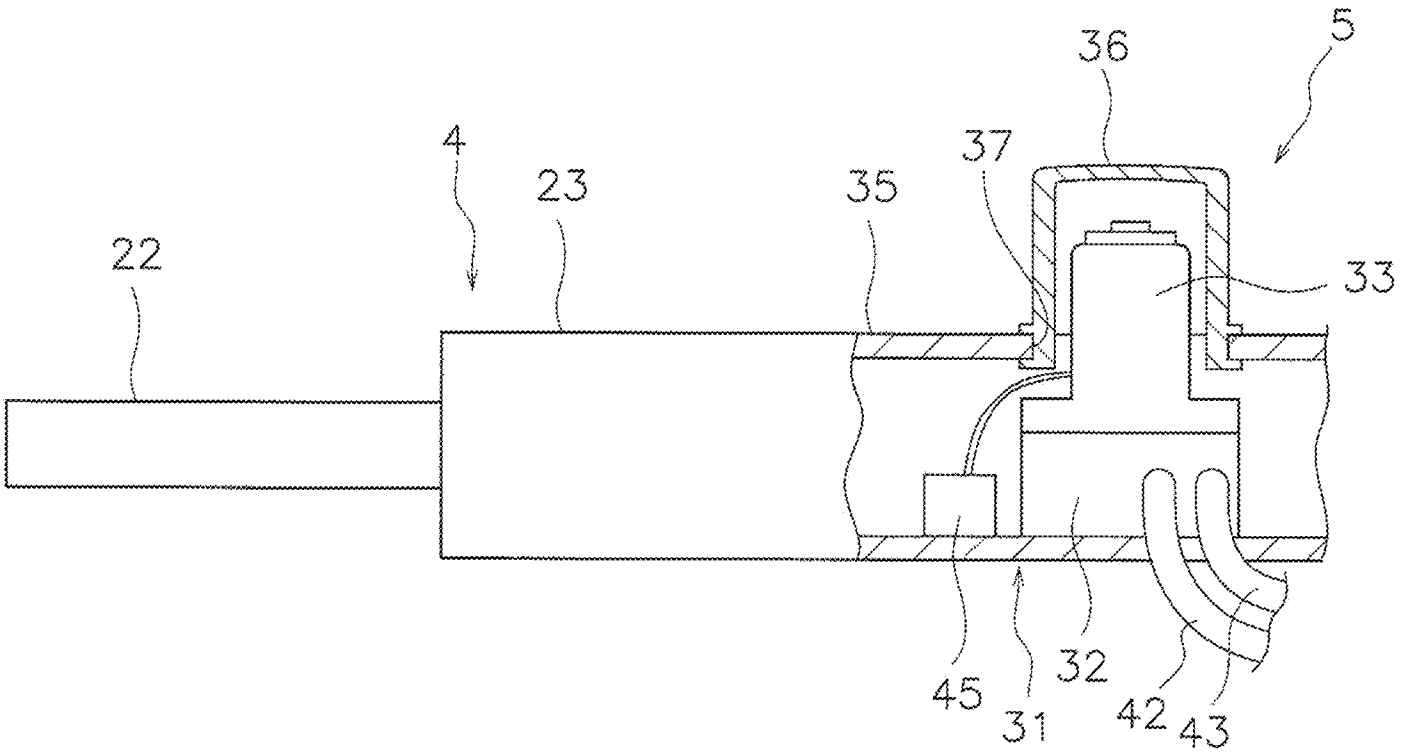
FIG. 3 is a side view of a tiller handle and a steering assist unit.
Figure 4:
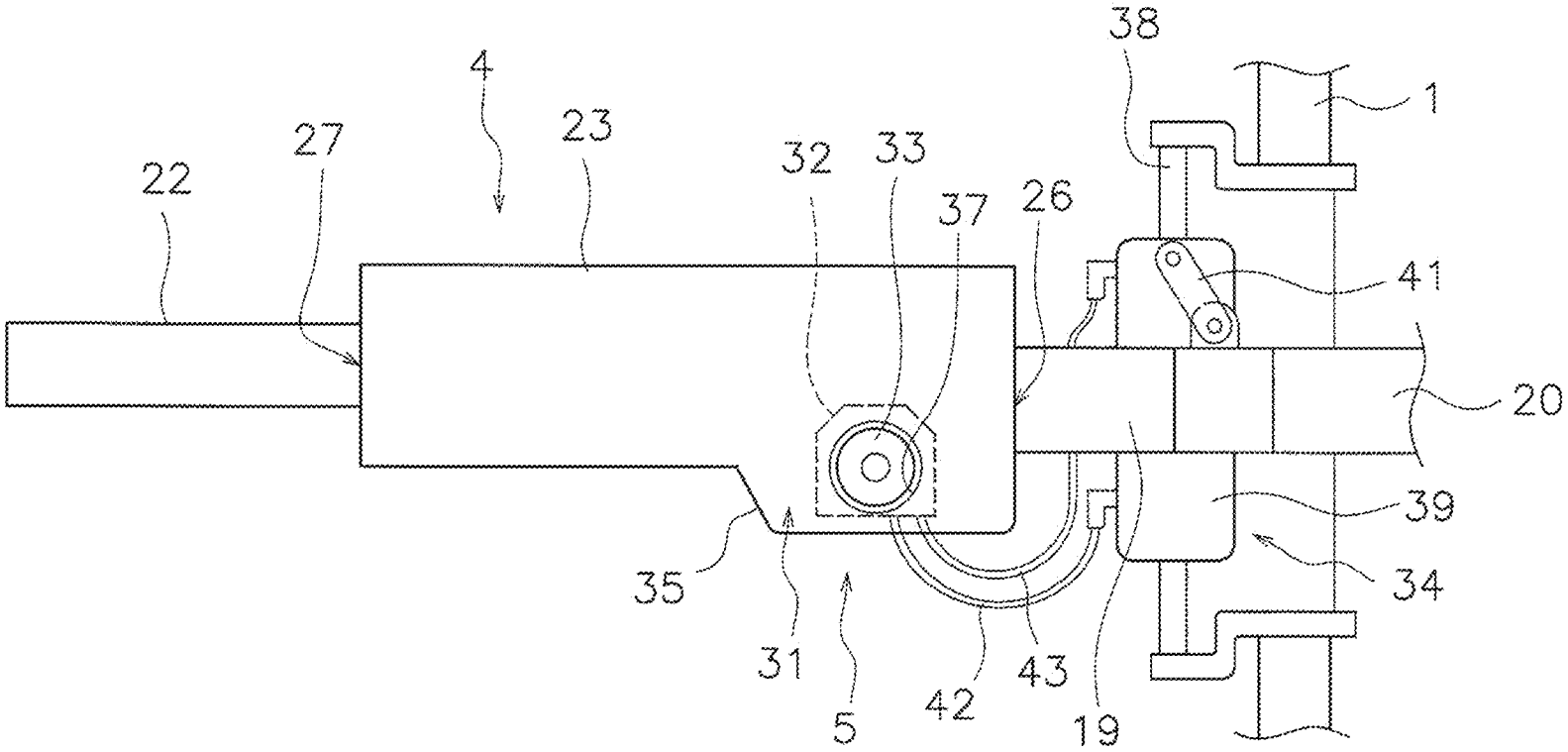
FIG. 4 is a top view of the tiller handle and the steering assist unit.

FIG. 3 is a side view of the tiller handle 4 and the steering assist unit 5. FIG. 4 is a top view of the tiller handle 4 and the steering assist unit 5. As illustrated in FIGS. 3 and 4, the tiller handle 4 includes a grip 22 and a handle body 23. The handle body 23 is connected to the outboard motor 3 by the handle bracket 19.

Figure 5:
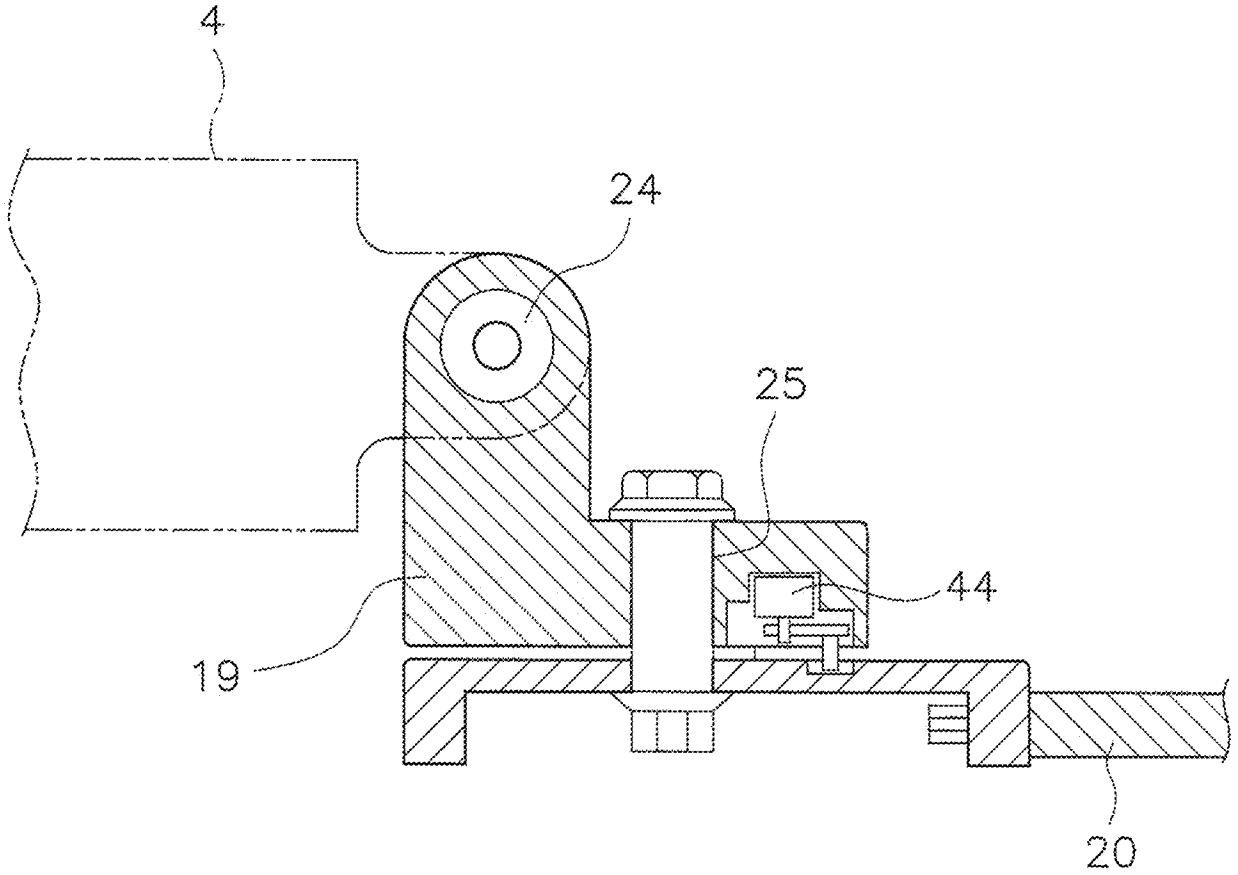
FIG. 5 is a cross-sectional view of a handle bracket.

The handle bracket 19 is separate from the handle body 23. The handle bracket 19 is detachably connected to the handle body 23. FIG. 5 is a cross-sectional view of the handle bracket 19. As illustrated in FIG. 5, the handle bracket 19 includes a first rotation shaft 24. The first rotation shaft 24 extends in the left-right direction of the outboard motor 3. The handle body 23 is supported by the handle bracket 19 swingably up and down around the first rotation shaft 24.

The handle bracket 19 is separate from the steering arm 20. The handle bracket 19 is detachably connected to the steering arm 20. The handle bracket 19 includes a second rotation shaft 25. The second rotation shaft 25 extends in the vertical direction. The handle body 23 is supported by the steering arm 20 by the handle bracket 19 swingably left and right around the second rotation shaft 25.

As illustrated in FIG. 4, the handle body 23 includes a first end 26 and a second end 27. The first end 26 is connected to the steering arm 20 by the handle bracket 19. The second end 27 is located on the opposite side of the first end 26. The second end 27 is connected to the grip 22.

As illustrated in FIGS. 3 and 4, the steering assist unit 5 includes a housing 31, a pump 32, a motor 33, and a hydraulic actuator 34. As illustrated in FIG. 3, the housing 31 includes a main body case 35 and a cover 36. The main body case 35 is connected to the handle body 23. The main body case 35 is integral with the handle body 23. However, the main body case 35 may be separate from the handle body 23.

The pump 32 and the motor 33 are housed or located in the housing 31. The motor 33 is connected to the pump 32. The motor 33 drives the pump 32. The pump 32 and the motor 33 are disposed closer to the first end 26 than to the second end 27.

The motor 33 is disposed above the pump 32. The main body case 35 includes a hole 37. The hole 37 is provided in the upper surface of the main body case 35. A portion of the motor 33 protrudes upward from the hole 37. The housing 31 further includes a cover 36 for the motor 33. The cover 36 is detachably attached to the main body case 35. In FIGS. 1 and 4, the cover 36 is omitted.

The hydraulic actuator 34 is driven by the hydraulic fluid from the pump 32. The hydraulic actuator 34 applies an assist steering force to the outboard motor 3. In the present preferred embodiment, the hydraulic actuator 34 is a hydraulic cylinder, for example. The hydraulic actuator 34 includes a rod 38 and a tube 39. The rod 38 is attached to the boat 1. The tube 39 is connected to the handle bracket 19 by a link 41. Alternatively, the tube 39 may be connected to the steering arm 20 or the tiller handle 4 by the link 41. The tube 39 is connected to the pump 32 by hydraulic hoses 42 and 43. The tube 39 moves left and right due to the hydraulic fluid supplied from the pump 32. Thus, an assist steering force to turn the outboard motor 3 to the left and right is generated.

The steering assist unit 5 includes a sensor 44 illustrated in FIG. 5 and a controller 45 illustrated in FIG. 3. As illustrated in FIG. 5, the sensor 44 is attached to the handle bracket 19. The sensor 44 is spaced apart from the second rotation shaft 25. The sensor 44 detects the angle of the tiller handle 4. The sensor 44 may be a position sensor that detects the displacement of the tiller handle 4. Alternatively, the sensor 44 may be a torque sensor. The sensor 44 may be provided on the steering arm 20.

The controller 45 includes a microcomputer and a memory. The controller 45 is connected to the sensor 44 by a communication line (not illustrated). The controller 45 receives a signal indicating the angle of the tiller handle 4 from the sensor 44. The controller 45 controls the motor 33 based on the angle of the tiller handle 4. Thus, the hydraulic actuator 34 is controlled to output an assist steering force according to the angle of the tiller handle 4.

In the boat maneuvering system 2 according to the present preferred embodiment described above, an assist steering force is obtained by the steering assist unit 5 when the tiller handle 4 is operated. In the steering assist unit 5, the pump 32 is attached to the tiller handle 4. Therefore, compared with the case where the pump 32 is located in the boat 1, the space in the boat 1 is not reduced.

The pump 32 is disposed near or adjacent to the second end 27 of the tiller handle 4. Therefore, a moment of inertia when the tiller handle 4 is operated is reduced. Thus, operability of the tiller handle 4 during steering is improved. Further, operability when the tiller handle 4 is tilted is improved.

A hole 37 is provided in the housing 31 at a position facing the motor 33. Therefore, arbitrarily selected types of pumps 32 and motors 33 having different sizes are able to be provided in the housing 31. Therefore, an appropriate pump 32 and motor 33 are able to be selected according to the output required of the steering assist unit 5.

The hole 37 and the motor 33 are covered with the cover 36. Therefore, sound emitted from the motor 33 is reduced.

While preferred embodiments of the present invention have been described above, it is to be understood that variations and modifications will be apparent to those skilled in the art without departing from the scope and spirit of the present invention.

Figure 6:
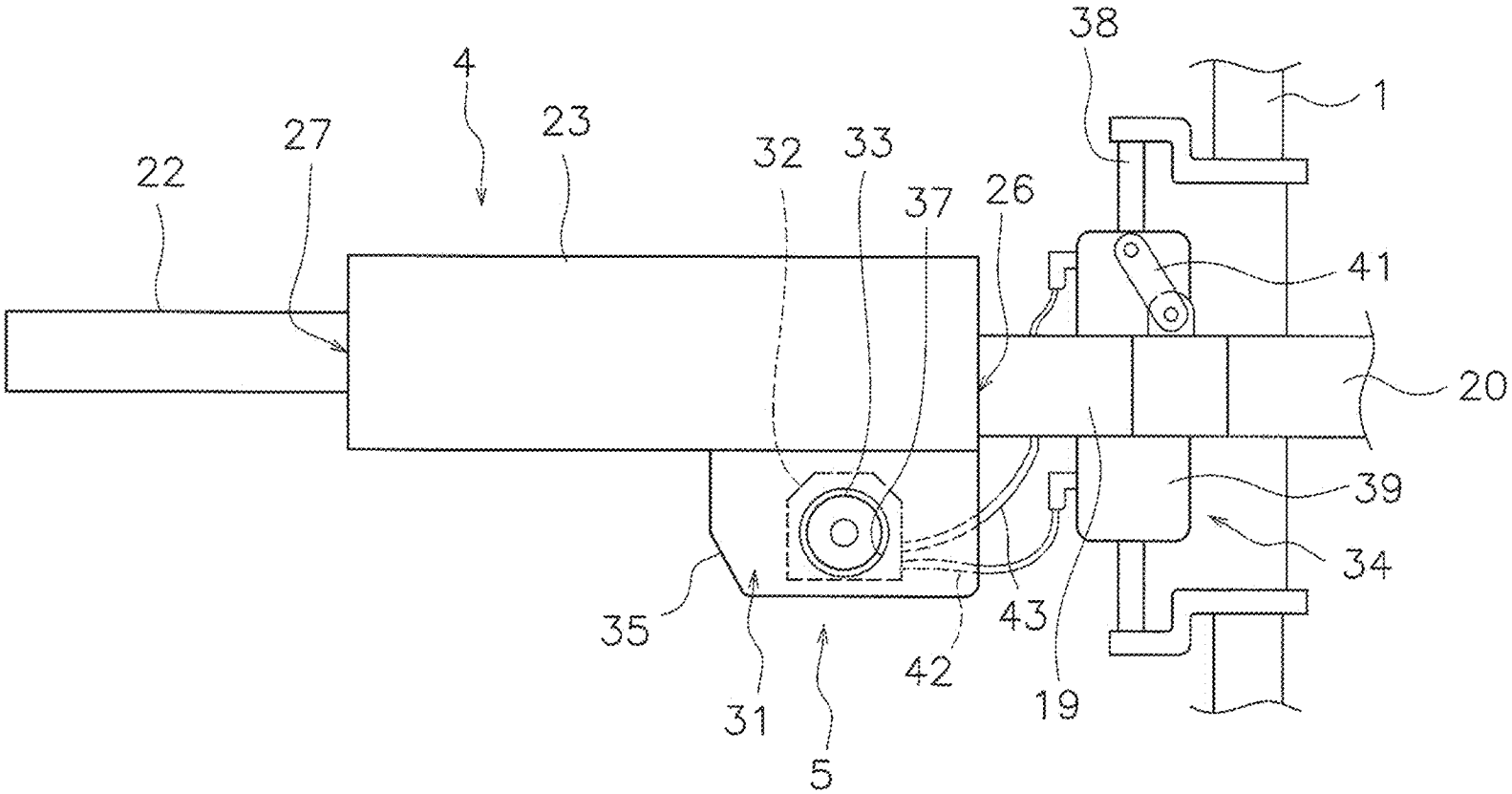
FIG. 6 is a top view of the tiller handle and the steering assist unit according to a first modification of a preferred embodiment of the present invention.

The configuration of the steering assist unit 5 may be changed. For example, FIG. 6 is a top view showing the steering assist unit 5 according to the first modification of a preferred embodiment of the present invention. As illustrated in FIG. 6, the steering assist unit 5 may be separate from the tiller handle 4. The steering assist unit 5 may be retrofitted to the ready-made tiller handle 4.

The hydraulic actuator 34 is not limited to a hydraulic cylinder, and may be changed. For example, the hydraulic actuator 34 may be a hydraulic motor. The arrangement of the pump 32 may be changed.

The configuration of the housing 31 may be changed. For example, the hole 37 of the housing 31 may be omitted. Alternatively, the hole 37 may be provided at a position other than the upper surface of the main body case 35. For example, the hole 37 may be provided on the lower surface of the main body case 35. In that case, a portion of the motor 33 may protrude downward from the hole 37. Alternatively, the hole 37 may be provided on the side surface of the main body case 35. In that case, a portion of the motor 33 may protrude laterally from the hole 37. The motor 33 may not protrude from the hole 37.

A switch may be provided on the tiller handle 4. The motor 33 may be controlled in accordance with the switch operation by the boat operator. Thus, the hydraulic actuator 34 may be controlled to output an assist steering force according to the operation of the switch.

Figure 7:
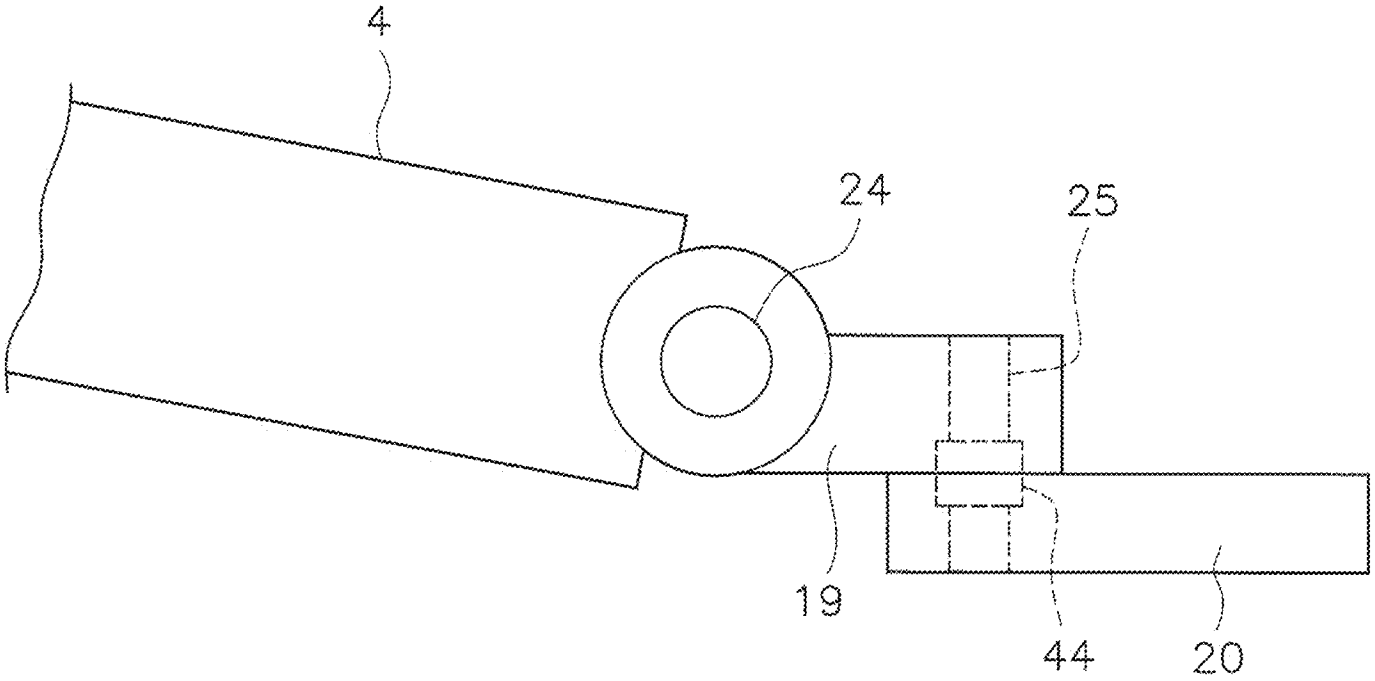
FIG. 7 is a side view of the tiller handle and the handle bracket according to a second modification of a preferred embodiment of the present invention.

The configuration of the sensor 44 may be changed. FIG. 7 is a side view showing the tiller handle 4 and the handle bracket 19 according to a second modification of a preferred embodiment of the present invention. As illustrated in FIG. 7, the sensor 44 may be disposed concentrically with the second rotation shaft 25.

Figure 8:
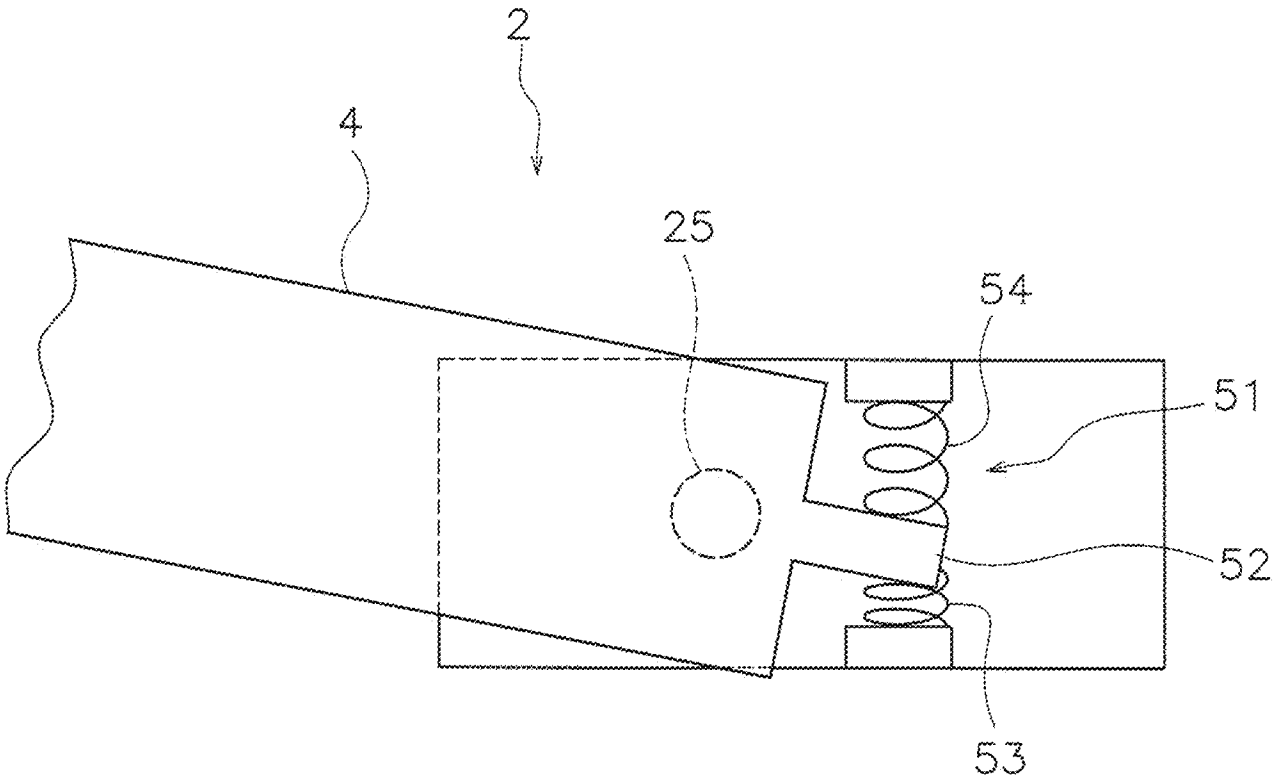
FIG. 8 is a top view of a portion of the boat maneuvering system according to a third modification of a preferred embodiment of the present invention.

FIG. 8 is a top view showing a portion of the boat maneuvering system 2 according to a third modification of a preferred embodiment of the present invention. As illustrated in FIG. 8, the boat maneuvering system 2 may include a position adjustment mechanism 51. The position adjustment mechanism 51 includes a support portion 52, a left elastic member 53, and a right elastic member 54. The support portion 52 is connected to the tiller handle 4. The support portion 52 is located rearward of the second rotation shaft 25. The left elastic member 53 is disposed on the left side of the support portion 52. The right elastic member 54 is disposed on the right side of the support portion 52. The left and right elastic members are, for example, springs. However, the left and right elastic members are not limited to springs, and may be other members such as rubber.

When the tiller handle 4 is steered to the right, the left elastic member 53 is compressed and the right elastic member 54 is extended. When the tiller handle 4 is steered leftward, the left elastic member 53 is expanded and the right elastic member 54 is compressed. Thus, an elastic force in a direction to return the tiller handle 4 to the neutral position acts on the tiller handle 4. When the tiller handle 4 is not operated, the tiller handle 4 is returned to the neutral position.

Figure 9:
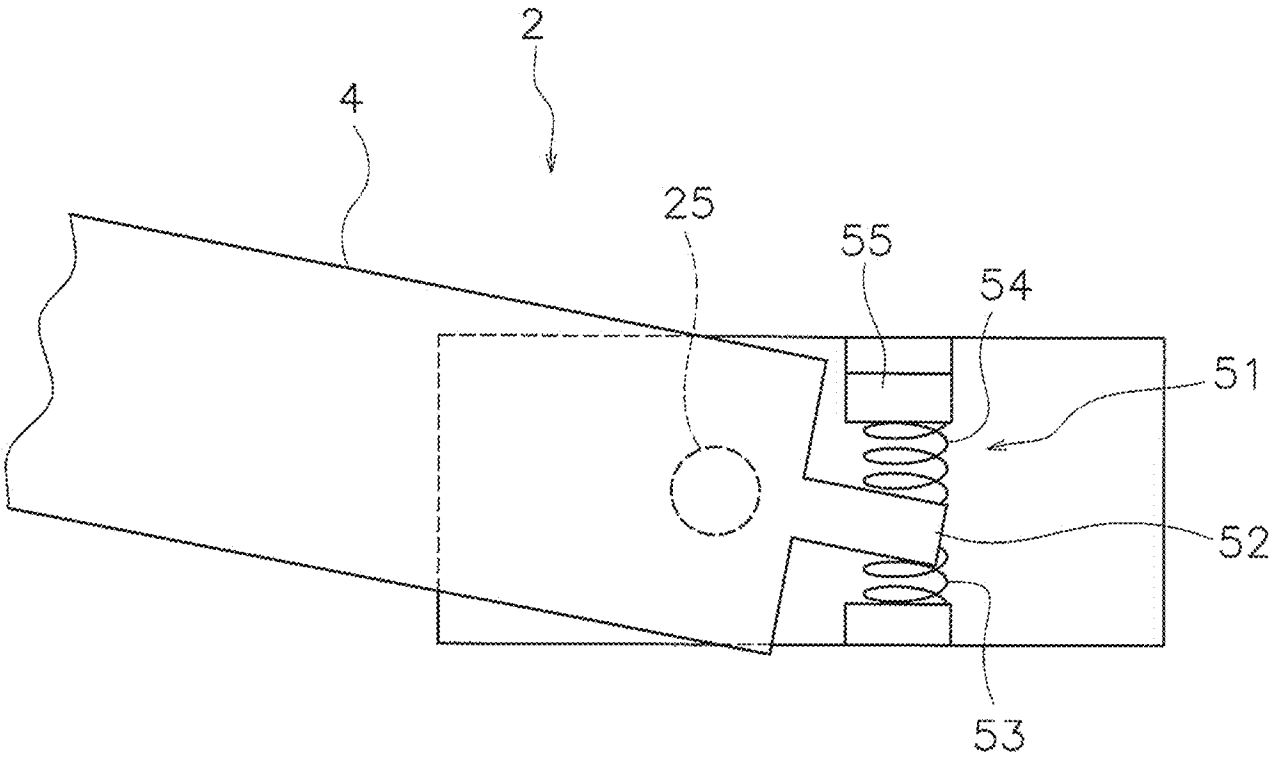
FIG. 9 is a top view of a portion of the boat maneuvering system according to a fourth modification of a preferred embodiment of the present invention.

FIG. 9 is a top view showing a portion of the boat maneuvering system 2 according to the fourth modification. As illustrated in FIG. 9, the position adjustment mechanism 51 may further include a spacer 55. Thus, the position of the neutral position is able to be adjusted. For example, as illustrated in FIG. 9, when the spacer 55 is disposed on the right side of the support portion 52, the neutral position is displaced to the left from the center position. When the spacer 55 is disposed on the left side of the support portion 52, the neutral position is displaced to the right from the center position.

It should be understood that arrangements described herein are for purposes of example only. As such, those skilled in the art will appreciate that other arrangements and other elements (e.g., machines, interfaces, orders, and groupings of operations, etc.) can be used instead, and some elements may be omitted altogether according to the desired results.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. It is also to be understood that the terminology used herein is for the purpose of describing particular implementations only, and is not intended to be limiting.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A steering assist unit for a tiller handle of an outboard motor, the steering assist unit comprising:
- a housing mountable to the tiller handle;
- a pump located in the housing; and
- a hydraulic actuator driven by hydraulic fluid supplied from the pump; wherein
- the hydraulic actuator applies an assist steering force to the outboard motor.

2. The steering assist unit according to claim 1, further comprising a motor located in the housing and that is connected to the pump.

3. A steering assist unit for a tiller handle of an outboard motor, the steering assist unit comprising:
- a housing connectible to the tiller handle;
- a pump located in the housing;
- a hydraulic actuator driven by hydraulic fluid supplied from the pump; and
- a motor located in the housing and that is connected to the pump; wherein
- the hydraulic actuator applies an assist steering force to the outboard motor;
- the housing includes a main body case including a hole; and
- a portion of the motor protrudes through the hole.

4. The steering assist unit according to claim 3, wherein the housing further includes a cover for the motor; and the cover is attached to the main body case.

5. The steering assist unit according to claim 3, wherein the portion of the motor protrudes through the hole in a vertical direction.

6. A steering assist unit for a tiller handle of an outboard motor, the steering assist unit comprising:
- a housing connectible to the tiller handle;
- a pump located in the housing;
- a hydraulic actuator driven by hydraulic fluid supplied from the pump;
- a sensor to detect an angle of the tiller handle; and
- a controller configured or programmed to control the hydraulic actuator based on the angle of the tiller handle; wherein
- the hydraulic actuator applies an assist steering force to the outboard motor.

7. The steering assist unit according to claim 6, wherein the sensor is attachable to a bracket that attaches the tiller handle to the outboard motor.

8. A steering assist unit for a tiller handle of an outboard motor, the steering assist unit comprising:
- a housing connectible to the tiller handle;
- a pump located in the housing; and
- a hydraulic actuator driven by hydraulic fluid supplied from the pump; wherein
- the hydraulic actuator applies an assist steering force to the outboard motor;
- the tiller handle includes a grip and a handle body;
- the handle body includes:
  - a first end connected to the outboard motor; and
  - a second end connected to the grip, the second end being located opposite to the first end; and
- the pump is closer to the first end than to the second end.

9. A boat maneuvering system comprising:
- an outboard motor;
- a tiller handle connected to the outboard motor; and
- a steering assist unit connected to the tiller handle, the steering assist unit including:
  - a housing mounted to the tiller handle;
  - a pump located in the housing; and
  - a hydraulic actuator driven by hydraulic fluid from the pump to apply an assist steering force to the outboard motor.

10. The boat maneuvering system according to claim 9, further comprising a motor located in the housing and that is connected to the pump.

11. A boat maneuvering system comprising:

an outboard motor;

a tiller handle connected to the outboard motor;

a steering assist unit connected to the tiller handle, the steering assist unit including:

a housing connected to the tiller handle;

a pump located in the housing; and a hydraulic actuator driven by hydraulic fluid from the pump to apply an assist steering force to the outboard motor; and a motor located in the housing and that is connected to the pump; wherein the housing includes a main body case including a hole; and a portion of the motor protrudes through the hole.

12. The boat maneuvering system according to claim 11, wherein the housing further includes a cover for the motor; and the cover is attached to the main body case.

13. The boat maneuvering system according to claim 11, wherein the portion of the motor protrudes through the hole in a vertical direction.

14. A boat maneuvering system comprising:

an outboard motor;

a tiller handle connected to the outboard motor;

a steering assist unit connected to the tiller handle, the steering assist unit including:

a housing connected to the tiller handle;

a pump located in the housing; and a hydraulic actuator driven by hydraulic fluid from the pump to apply an assist steering force to the outboard motor;

a sensor that detects an angle of the tiller handle; and a controller configured or programmed to control the hydraulic actuator based on the angle of the tiller handle.

15. The boat maneuvering system according to claim 14, further comprising a bracket; wherein the tiller handle is connected to the outboard motor by the bracket; and the sensor is attached to the bracket.

16. A boat maneuvering system comprising:

an outboard motor;

a tiller handle connected to the outboard motor; and a steering assist unit connected to the tiller handle, the steering assist unit including:

a housing connected to the tiller handle;

a pump located in the housing; and a hydraulic actuator driven by hydraulic fluid from the pump to apply an assist steering force to the outboard motor; wherein the tiller handle includes a grip and a handle body;

the handle body includes:

a first end connected to the outboard motor; and a second end connected to the grip, the second end being located opposite to the first end; and the pump is closer to the first end than to the second end.

* * * * *